US006915184B2

(12) United States Patent
Yates et al.

(10) Patent No.: US 6,915,184 B2
(45) Date of Patent: Jul. 5, 2005

(54) COLLATOR

(75) Inventors: Keith John Yates, Essex (GB); David Mark Dronsfield, Essex (GB); Richard Stephen Maher, Essex (GB); Damon Peter Smith, Essex (GB)

(73) Assignee: PFE International Limited, Loughton (GB)

( * ) Notice: Subject to any disclaimer, the term of this patent is extended or adjusted under 35 U.S.C. 154(b) by 159 days.

(21) Appl. No.: 10/459,571

(22) Filed: Jun. 12, 2003

(65) Prior Publication Data

US 2003/0233167 A1 Dec. 18, 2003

(30) Foreign Application Priority Data

Jun. 14, 2002 (GB) ..... 0213801

(51) Int. Cl.[7] ..... G06F 7/00

(52) U.S. Cl. ..... 700/224; 700/223; 270/52.02; 270/52.16

(58) Field of Search ..... 700/213, 223, 700/224; 270/52.02, 52.06, 58.3

(56) References Cited

U.S. PATENT DOCUMENTS 4,800,505 A * 1/1989 Axelrod et al. ..... 700/221
5,519,624 A * 5/1996 Hidding ..... 700/213
5,734,566 A * 3/1998 Stengl ..... 700/9
6,224,048 B1 * 5/2001 Motamed ..... 270/52.02
6,792,011 B2 * 9/2004 Hayes ..... 372/28
6,826,445 B2 * 11/2004 DiNapoli et al. ..... 700/223

* cited by examiner

*Primary Examiner*—Khoi H. Tran
(74) *Attorney, Agent, or Firm*—Young & Thompson

(57) ABSTRACT

A document collator comprising a conveyor system, a prime document feeder station and a plurality of enclosure document feeder stations arranged at spaced locations along the conveyor system, a collation station located downstream of the feeder stations at one end of the conveyor system, and control elements, including elements for determining which one of the plurality of feeder stations is the prime feeder station, the control elements being operable to control each feeder station independently in such a way as to ensure that the documents from each of the enclosure document feeder stations located upstream of and including the prime feeder station are stacked one on top of each other with the prime document on top and the documents from each of the feeder stations downstream of the prime feeder station are stacked one on top of each other.

12 Claims, 9 Drawing Sheets

COLLATOR

The present invention relates to a collator and particularly to a track system for transferring documents from a number of individual feed stations and assembling them ready for insertion into an envelope.

Track systems are known and traditionally documents are fed from a series of feed stations in a synchronised manner so that a document from each feed station is placed on top of a document from a preceding, up-stream feed station. A number of documents are collated together in this way and at the end of the track they are inserted into an envelope. Usually the documents comprise one prime document, such as a personally addressed letter, and several attachments, such as leaflets or advertisements. The prime document usually has the address to which the package is to be sent and the collating must be done so that when the documents are placed in a window envelope, the address will be visible through the window. This can be done by first feeding the prime document onto the track conveyor, face downwards, and adding the subsequent documents on top to form a package which is then inserted into the envelope with the prime document facing downwards. This has the disadvantage that the envelope must be turned before it can be franked for dispatch in the mail. Turning the envelope requires an extra mechanism and makes the machinery more expensive. It would be advantageous to collate the package with the prime document on top.

Some traditional machines require the prime documents to be located in the furthest feed station particularly when the prime document is used to intelligently control the assembly of the package, for example by marks on the prime documents to control selective feeding of the inserts. This inflexibility means that the prime feeder station must be moved if further feeder stations are added, i.e. if more inserts are required.

It would be advantageous to have a collator in which the documents are collated with the prime document on top and in which any feeder station may be used for the prime document.

According to one aspect of the present invention there is provided a document collator comprising a conveyor system, a prime document feeder station and a plurality of enclosure document feeder stations arranged at spaced locations along the conveyor system, a collation station located downstream of the feeder stations at one end of the conveyor system, and control means, including means for determining which one of the plurality of feeder stations is the prime feeder station, the control means being operable to control each feeder station independently in such a way as to ensure that the documents from each of the enclosure document feeder stations which are located upstream of and including the prime feeder station are stacked one on top of each other with the prime document on top to form a prime document package and the documents from each of the feeder stations downstream of the prime feeder station are stacked one on top of each other to form an enclosure document package, and the prime document package is transported along the conveyor system at a distance from and upstream of the enclosure document package, the collator further comprising means for holding the enclosure package in the collation station and feeding the upstream prime document package onto the top of the downstream enclosure package with the prime document on top.

The packages may be trailing edge or leading edge aligned as they are conveyed along the track but trailing edge alignment is generally preferred.

The prime document feeder station may be detected automatically from document sensors, for example by reading OMR code or barcode printed on the prime document. Alternatively the operator may enter information manually.

According to one embodiment of the invention a track control sensor is arranged upstream of each feeder station and the feed operation is governed by software timings to set a controlled predetermined gap between documents on the conveyor, particularly between the prime document package and the enclosure document package. The feeder timings are triggered when an edge of a document passes through a track control sensor. Preferably the trailing edge of a document is used as a trigger, but the leading edge may be used.

According to a particularly preferable embodiment, entry of documents into the collation station is controlled by a pair of retard rollers comprising a first, main, retard transport roller and a second retard roller wherein at least one of the retard rollers is resiliently biased towards the other retard roller.

According to one embodiment the main retard roller is rotated at one or the other of two different speeds, for example using two independent clutches. The first clutch preferably drives the rollers at the same speed as the conveyor. A document sensor, positioned at a predetermined distance upstream of the retard rollers detects the trailing edge of a document and sends a signal to the control means which then disengages the first clutch and engages the second clutch to drives the retard rollers at a significantly slower speed. In this way the documents can be driven at a fast speed along the conveyor until the collation station when they are slowed so as to be accurately and gently deposited in the collation station. Preferably the speed change occurs just as the document or document package leaves the retard rollers.

Any other means for changing the speed, between a higher input speed as the document enters the collation station to a lower speed as it is finally released into the collation station, could be used e.g. a single motor which is directly switched between the two speeds. This may be a DC motor, stepper motor, or any other suitable motor.

Software in the control means calculates a suitable time to swap the speed to the slow drive and back to the fast drive depending upon when each successive document passes the collation station entry sensor, the speed of the conveyor system and the length of each document or package.

According to a second aspect of the invention there is provided a method for collating a prime document with one or more enclosure documents to form a document package, the method comprising identifying a prime station document and feeding documents onto a conveyor system in such a way that enclosure documents from feeder stations upstream of and including the prime feeder station are formed in a stack one on top of each other with the prime document on top of to form a prime document package, and the enclosure documents from feeder stations downstream of the prime document feeder station are stacked one on top of each other to form an enclosure document package, and for each document package, a prime document package follows the respective enclosure document package along the conveyor system, separated therefrom by a predetermined gap. The predetermined gap may be controlled according to calculations by control means depending upon conveyor speed, document length and other factors, A collator according to the present invention significantly improves machine throughput without increasing linear transport speeds. The machine cycle time is unaffected by the number of insert feeders: the only limitation is the maximum package thickness that can be inserted or transported along the conveyor system. The insert feeders do not need to be spaced so as to correspond to the actual pitch space between documents and thus the machine footprint can be significantly reduced. In addition such a collator provides a versatile machine since the prime insert feeder does not need to be fitted as the last station and multiple sets of documents can be fed from an individual feed station. The collator allows for leading or trailing edge collation on the track although trailing edge collation is preferred.

For a better understanding of the present invention, and to show how the same may be carried into effect, reference will now be made to the accompanying drawings, in which.

The system in each figure comprises a collation station I into which all the documents are ultimately fed from any one or any combination of feeder stations A, B, C and D. Like parts of each feeder station are denoted by the same reference numerals.

Figure 1:
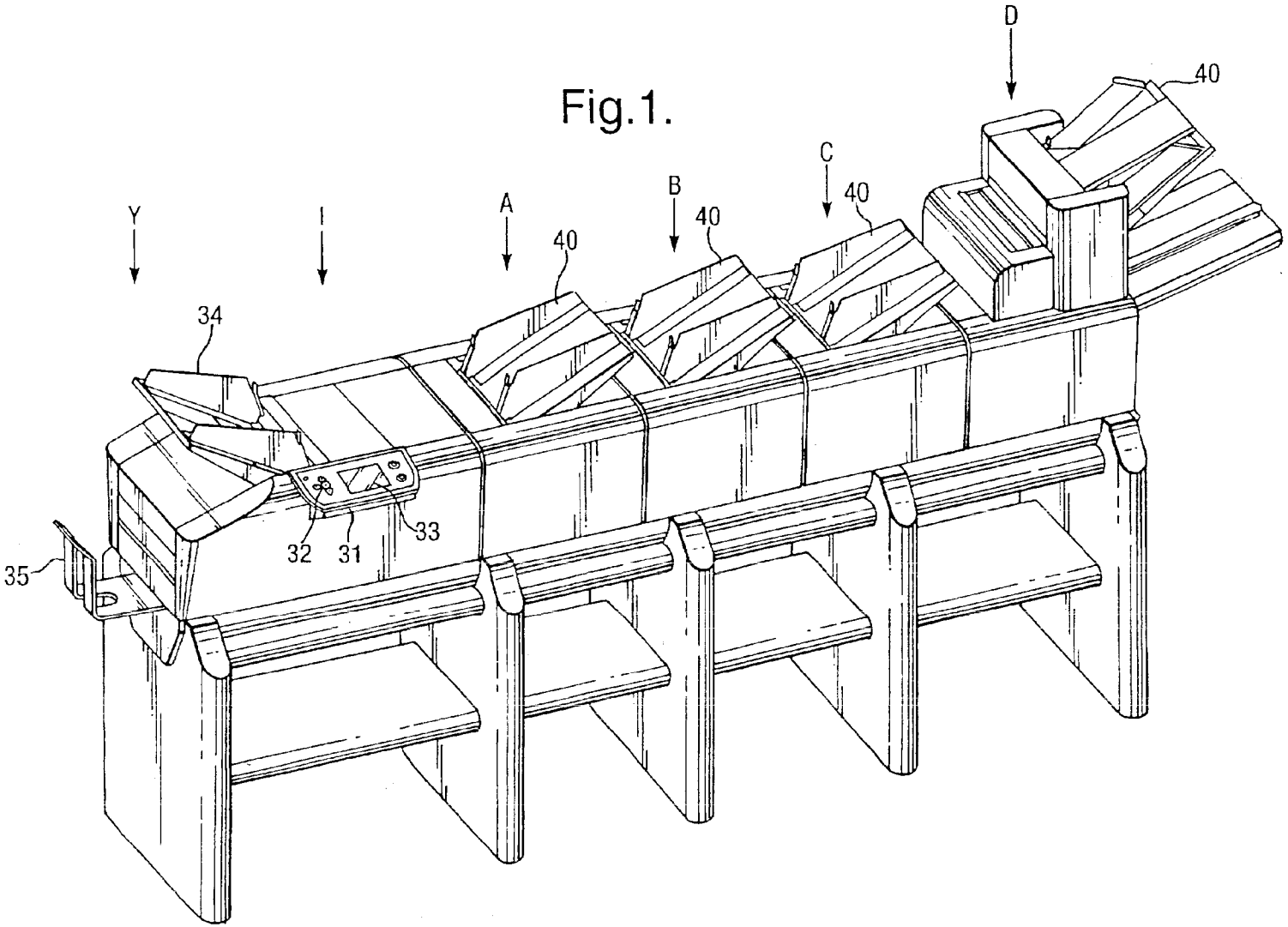
FIG. 1 is a perspective view of one embodiment of a collator according to the invention.

In FIG. 1 it can be seen that each feeder station A, B, C, D comprises a document holding hopper 40. A series of conveyor belts and sensors links the feeder stations A, B, C, D and are described in detail with reference to FIGS. 2 to 9 below. A control panel 31 is positioned towards the collation station I at one end of the collator and comprises an array of keys 32 and a display 33 for use by a machine operator to enter operating parameters such as the choice of prime document feeder station, whether inserts are selected manually and from which stations, or whether they are selected automatically, for example by reading a bar code or other markings on the prime document. The control panel 31 may alternatively comprise a full size PC with a monitor and full size keyboard, for example mounted above the collator.

In the example shown in FIG. 1, station D is chosen as the prime document feeder station. This comprises at least one holding hopper 40, a prime document collator for when the prime document consists of more than one sheet of paper, and a folder to reduce the footprint of the prime document to fit into the chosen envelope size. An optical reader may also be incorporated to read coding on the prime document for control and statistical purposes.

As shown in FIGS. 2 to 9 each feeder station comprises, downstream of the respective document holding hopper 40 shown in FIG. 1, an exit hold point platform 2 and an exit hold point sensor 3 which is located on or adjacent the platform 2. A conveyor system 4 links the feeder stations and may comprise a single continuous conveyor track or alternatively, as shown, a series of adjacently located conveyor tracks bridging the gaps between each of the feeder stations A, B, C and D and between the collation station I and the first feeder station A. The tracks each comprise a lower conveyor belt 5 which passes over rollers 6 and an upper conveyor belt 9 which passes over rollers 10. The belts 5, 9 are continuously running. Many arrangements for driving and tensioning the belts will be evident to skilled persons. As one example, both the upper and lower belts may be driven synchronously; the left hand rollers being the driven rollers, and the right hand rollers following in each case.

The lower rollers 6 and the upper right hand roller 10 are each independently mounted on spring loaded bearings so that they automatically allow for the gap between the belts 5 and 9 to be increased as a document or package passes between them, to accommodate a variety of thickness of package. It is envisaged that a package thickness of at least 6 mm should be accommodated. The resilient bearings may take the form of spring loaded T bearings mounted in slots in support frames.

A track control sensor 7 is located adjacent each pair of conveyor belts 5, 9 in the vicinity of the subsequent feeder station. Rollers 8 control the exit of a document from respective feeder platforms 2 and are selectively driven by the control means. A control idler roller 11 is movable to control the tension in the upper conveyor belt 9. In practice this may be mounted on a pivoted arm. Documents move along the conveyor system 4 by being engaged between the pairs of adjacent conveyor belts 5 and 9.

Arrow 12 shows the direction of feed of documents from the hopper to the platform 2 of station D and arrow 13 shows the direction of movement of documents along the conveyor system. Between feeder station A and collation station I is a further double conveyor belt system comprising lower conveyor belt 14 driven by rollers 15 and upper conveyor belt 16 driven by rollers 17. Both belts 14 and 16 are driven, the lower belt 14 by means of the left hand lower roller 15 which is driven and fixed, and the upper belt 16 by another gear (not shown). The right hand lower roller 15 and the two upper rollers 17 follow and are mounted on spring loaded bearings to accommodate different thicknesses of paper.

A collator in-feed sensor 18 is located at the exit of this double conveyor 14/16 and a pair of retard rollers 19/20 comprising lower main roller 19 and upper secondary roller 20 are located downstream of the collator in-feed sensor 18 and upstream of the collation station I. The upper secondary retard roller 20 is biased by a spring 21 towards the main retard roller 19.

These rollers are controlled by two independently engageable clutches, or other means for varying the speed, which are not shown. One clutch drives the rollers 19/20 at a fast speed to move the packages at the same speed as the belts 5/9. The second clutch drives the rollers 19/20 at a slower speed. A collation conveyor 22 is located below the collation station I and driven by rollers 23 and this conveyor 22 carries an insert drive pawl 24 which pushes collated documents out of the station I at appropriate intervals determined either mechanically by the length of conveyor 22 as shown or by a microprocessor controlled system (not shown).

Figure 2:
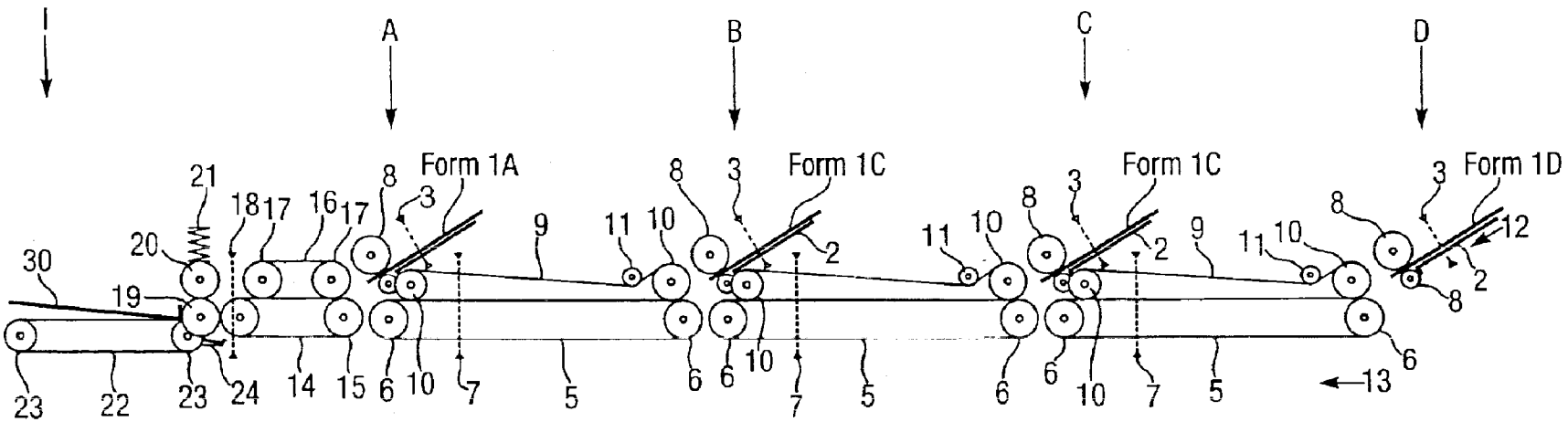
FIGS. 2 to 9 are schematic representations of a collator according to the invention at different times in the sequence of operation.

Different documents are put in to the hoppers of each of the feeding stations A, B C and D and are fed one at a time to the respective feed platforms 2. In feeding the document to the feed platform, any intelligent information is read, the documents have been grouped and folded, the length of the folded item measured and the position of both the leading edge and trailing edge registered to the reference position of the feed platform. In FIG. 2 a single document form 1A is present on platform 2 of feeder station A, document form 1B is present on platform 2 of feeder station B, document form 1C is present on platform 2 of feeder station C and document form 1D is present on the platform of feeder station D.

Figure 3:
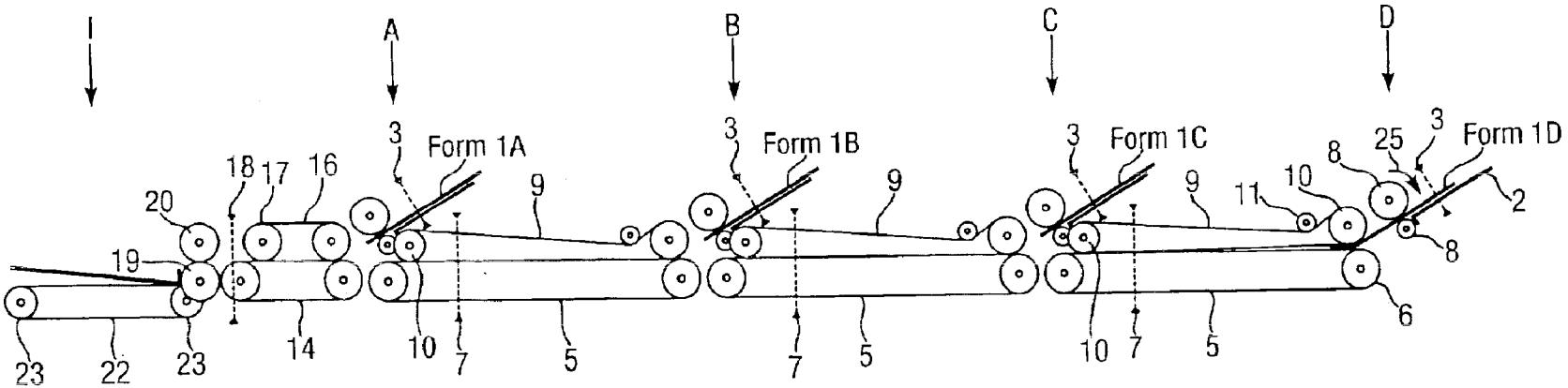

The first step in the operation of this collator system is shown in FIG. 3 where document form 1D is, in this example, the prime document with appropriate identification details of the intended recipient. Hence data such as the name and address of the intended recipient and any other personal data is printed on the document. The letter may for example be a bank statement or mortgage statement. Feeder stations A, B and C comprise other documents to be collated with the prime document from 1D and these may for example be enclosures such as sheets of advertising literature, brochures or leaflets or other non recipient-specific documents.

Figure 4:
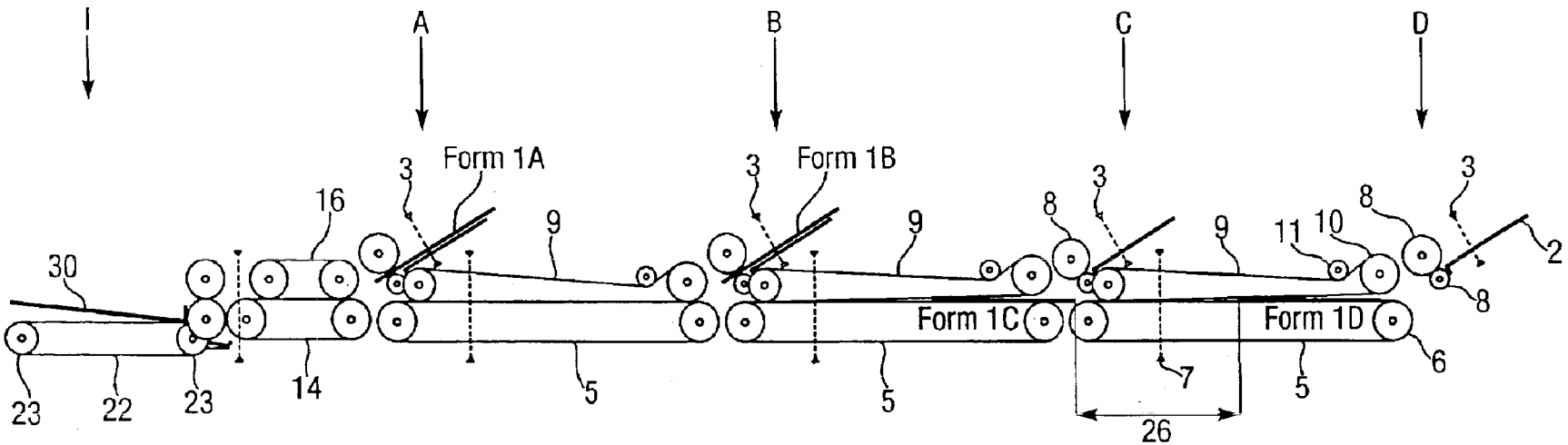
Figure 5:
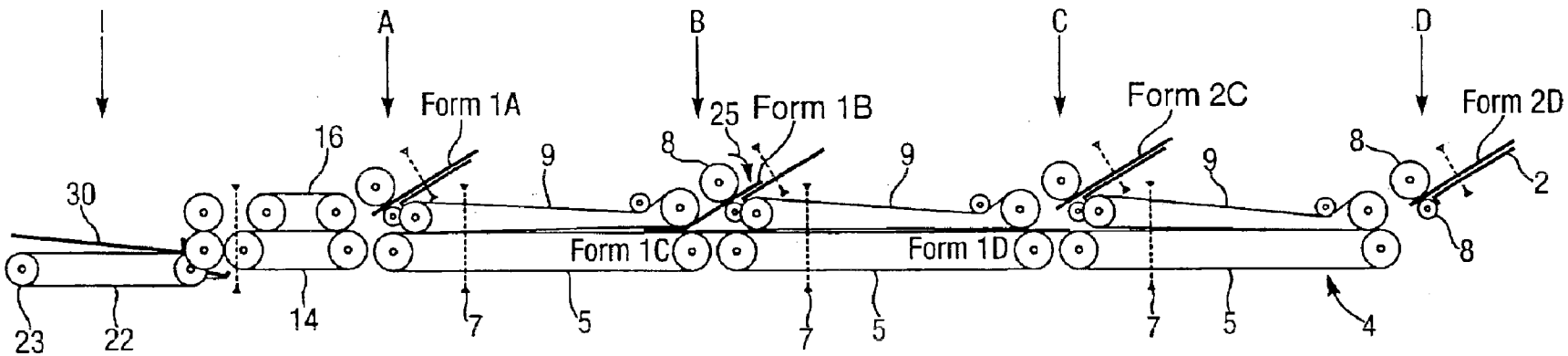

As shown in FIG. 3 the prime document form 1D is fed from feeder platform 2 of station D when rollers 8 are activated to turn in the direction of arrow 25. Form 1D passes between rollers 6 and 10 and thus between conveyor belts 5 and 9 which are driven continuously and carry form 1D towards feeder station C. The trailing edge of form 1D is detected by sensor 3 in station D and this information is passed to the control means which calculates the time at which form 1C should be fed to the conveyor system 4 in order to ensure a predetermined gap 26 between the leading edge of form 1D and the trailing edge of form 1C. This is shown in FIG. 4. Forms 1C and 1D continue along the conveyor system 4 separated by this gap 26. When the trailing edge of form 1C is detected by sensor 7 upstream of feeder station B then the control system activates the rollers 8 at feeder station B to turn in the direction of arrow 25 to move form 1B onto the conveyor system 4 on top of and in alignment with the trailing edge of form 1C. Meanwhile feeder platforms 2 in feeder stations C and D are refilled with appropriate forms in readiness to form a second package. Thus form 2C is fed from the hopper 40 of station C to the platform 2 of station C and the second prime document form 2D is fed from the hopper 40 to the platform 2 of station D. Forms 1B, 1C and 1D continues along the conveyor system 4 towards the collation station I and form 1A is added to the first package formed by forms 1B and 1C while form 1D follows at a distant defined by the predetermined gap 26.

Figure 6:
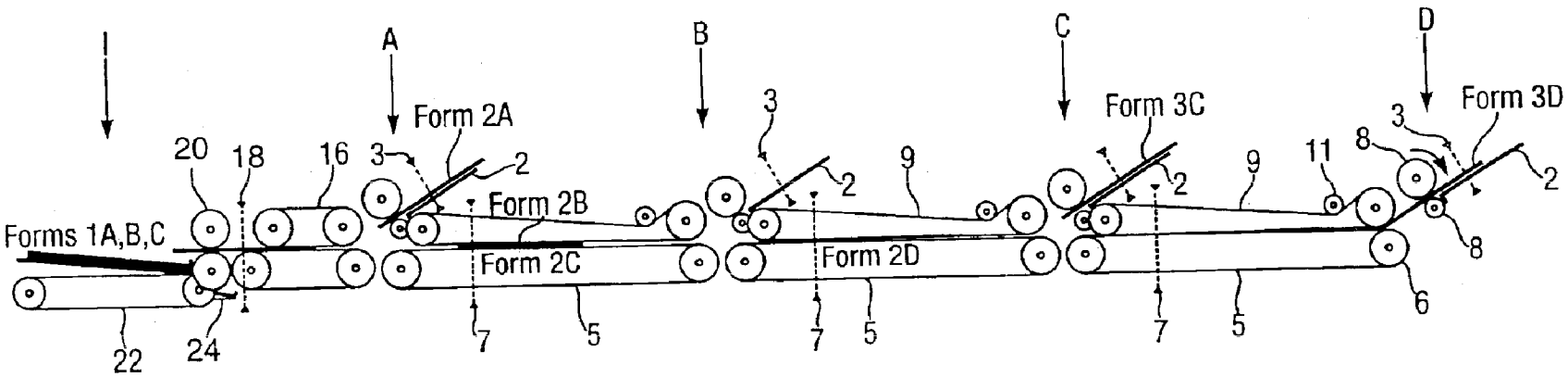
Figure 7:
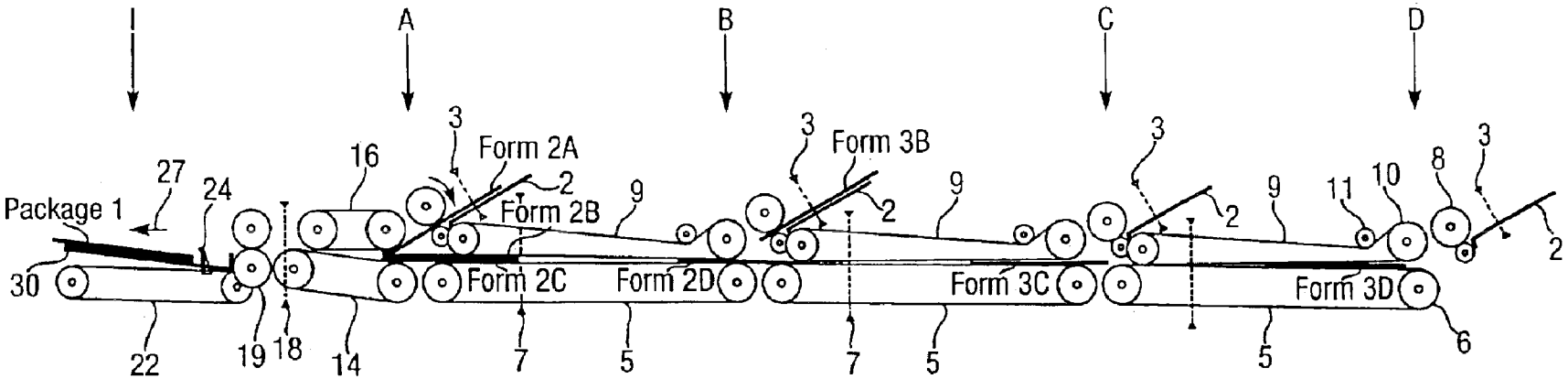

When the first package formed by the stack of forms 1A, 1B and 1C has reached the collation station I, as shown in FIG. 6, they rest on collation platform 30. This package is also decelerated by switching roller speeds etc as the final portion of the package is released by the rollers 19, 20. At this stage form 1D is passing between the conveyor belts 14 and 16 and the retard rollers 19 and 20. The trailing edge of form 1D passes the collation in-feed sensor 18, and the control means calculates the time to change the speed of the retard rollers 19, 20 to drive the rollers 19, 20 at a slower rate and the final portion of form 1D is relatively slowly driven into the collation pocket to rest cleanly on top of forms 1A, 1B and 1C as shown in FIG. 7. This speed change will occur after a defined delay following the form clearing the in-feed sensor 18. This delay is the retard distance.

The same speed change occurs a predetermined delay after any form or package passes sensor 18: thus, knowing the pack length, the last portion of the first package comprising forms 1A, 1B and 1C is driven into collation station 1 relatively slowly.

In FIG. 7 the insert drive pawl 24 is shown pushing the completed collated first package away from the collation station I to be inserted into an envelope which may subsequently be franked. The faster drive means is then switched in and retard rollers 19 and 20 are driven at faster speed.

Meanwhile a second package is being formed, as shown in FIG. 7. Forms 2C and 2B, lying one on top of the other, have arrived at station A and form 2A is being fed to lie on top of form 2B. Form 2D is at station B separated by a predetermined controlled gap 26. Form 3B, which is to form part of the third package is on platform 2 of station B, form 3C has just exited station C and form 3D has just exited station D.

Figure 8:
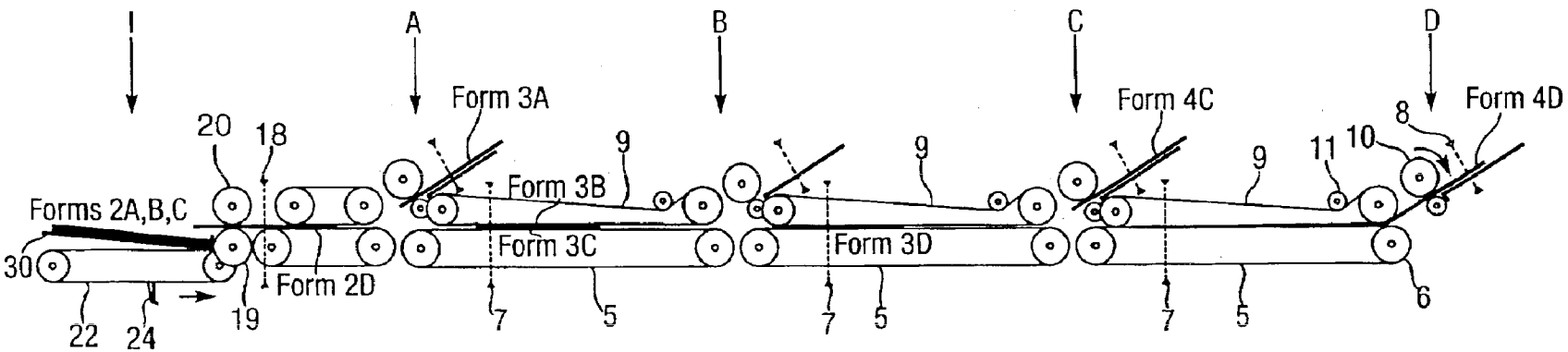

In FIG. 8 forms 2A, 2B and 2C are collated together and lying on the collation platform 30 in the collation station I, and the prime document form 2D is being slowed as it enters the retard rollers 19, 20 ready to be placed on top of forms 2A, 2B and 2C on the collation platform 30. Meanwhile form 3A is at station A and forms 3B and 3C are together approaching station A. At a controlled gap 26 upstream, form 3D is approaching station B, and forms 4C and 4D have been fed from hoppers 40 to the platforms 2 of stations C and D.

Figure 9:
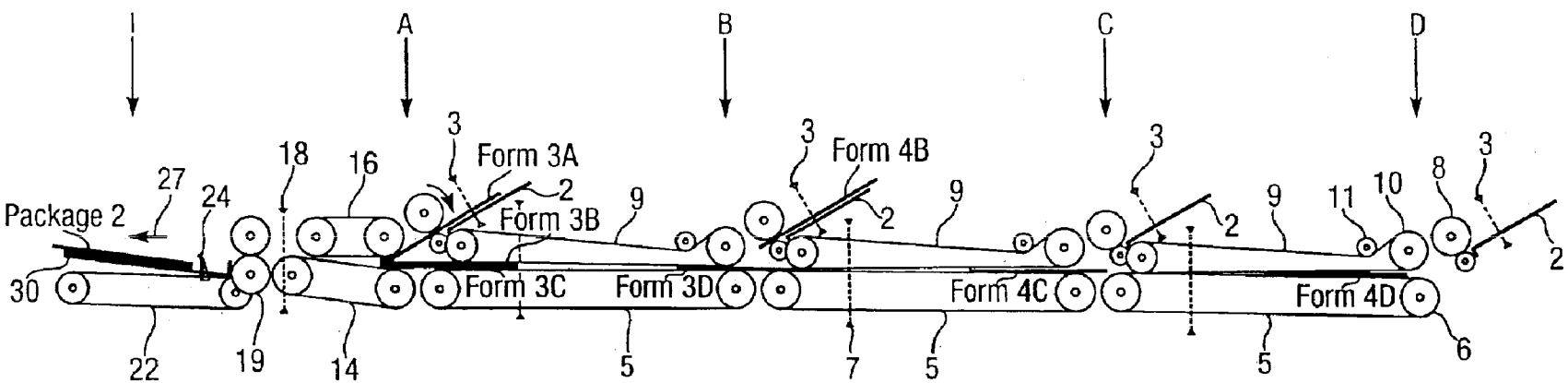

In FIG. 9 the second package 2 comprising forms 2A, 2B, 2C and prime document form 2D on top, has been assembled and is being pushed by the insert drive pawl 24 out of the collation station I, in the direction of arrow 27. In station A form 3A is being added to forms 3B and 3C and form 3D is passing through station B. The forms ready to form a fourth package comprise form 4B on the platform 2 at station B, form 4C which is just leaving station C and form 4D which is just leaving the station D.

In this manner the cycle repeats and further packages are continuously created.

Each time a document or a package of documents passes through the retard rollers 19/20, the retard roller drive system is swapped to drive the rollers at a slower speed and thus slow the document or documents. Software controls the timing of the drive swapping to accurately control the slowing down of the documents using information from the collation station entry sensor 18 so as to maximise the time at which the conveyor can run at high speed and minimise the low speed running time.

OMR reading on any document may be performed before the document reaches the platforms 2, ie the hold point. Documents requiring folding are also folded before they reach the platform 2. In general the prime document may be folded between hopper 40 and platform 2 but the enclosure document will generally (if necessary) be prefolded when they are placed in the hoppers 40.

Any one of the feeder stations may be used as the prime feeder station and this may be detected by an OMR code or a barcode printed on each prime document and including an OMR or barcode reader in the collator. Alternatively an operator can enter the information manually. The prime document will be transported along the conveyor system separated from downstream enclosure documents by a controlled gap but may be placed on top of upstream items, if there are any, depending upon which station is chosen as the prime document feeding station.

A microprocessor may be incorporated into the apparatus to effect control of the feeder stations. It is possible to enable such a microprocessor to track individual items, for example by means of identifying marks on the prime document and records may be maintained of when an individual item was collated and inserted into an envelope.

The microprocessor may also maintain a prefeeding assessment of the apparatus and determine the length of document and the speed of the track so as to accurately establish the position of the trailing edge of each document and of the packages moving along the track.

What is claimed is:

1. A document collator comprising a conveyor system, a prime document feeder station and a plurality of enclosure document feeder stations arranged at spaced locations along the conveyor system, a collation station located downstream of the feeder stations at one end of the conveyor system, and control means, including means for determining which one of the plurality of feeder stations is the prime feeder station, the control means being operable to control each feeder station independently in such a way as to ensure that the documents from each of the enclosure document feeder stations which are located upstream of and including the prime feeder station are stacked one on top of each other with the prime document on top to form a prime document package and the documents from each of the feeder stations downstream of the prime feeder station are stacked one on top of each other to form an enclosure document package, and the prime document package is transported along the conveyor system at a predetermined distance from and upstream of the enclosure document package, the collator further comprising means for holding the enclosure package in the collation station and feeding the upstream prime document package onto the top of the downstream enclosure package with the prime document on top.

2. A document collator according to claim 1 wherein each of the packages are trailing edge aligned as it is conveyed along the conveyor system.

3. A document collator according to claim 1 wherein the location of the prime document feeder station is automatically determined.

4. A document collator according to claim 1 wherein the location of the prime document feeder station is determined by manual operator input.

5. A document collator according to claim 1 wherein an exit hold point sensor is arranged upstream at each feeder station and supplies a trigger signal to the control means indicative of a document passing the respective sensor.

6. A document collator according to claim 5 wherein the exit hold point sensor detects when a trailing edge of a document passes and supplies the trigger signal in dependence thereon.

7. A document collator according to claim 1 wherein entry of a document into the collation station is controlled by a pair of retard rollers comprising a first, main, retard transport roller and a second retard roller wherein at least one of the retard rollers is resiliently biased towards the other retard roller.

8. A document collator according to claim 7 comprising means for driving the main retard roller at two different drive speeds, wherein the first drive speed preferably drives the retard rollers at the same speed as the conveyor system and the second drive speed is slower than the first drive speed.

9. A document collator according to claim 1 wherein a document sensor is positioned at a predetermined retard distance upstream of the retard rollers, to detect the trailing edge of a document and send a signal to the control means which subsequently changes the drive speed of the retard rollers from the first to the second speed.

10. A method for collating a prime document with one or more enclosure document to form a document package, the method comprising identifying the prime station document and feeding the documents into a conveyor system in such a way that the enclosure documents from feeder stations upstream of and including the prime feeder station are formed in a stack one on top of each other with the prime document on top to form a prime document package and the enclosure documents from feeder stations downstream of the prime document feeder station are stacked one on top of each other to form an enclosure document package, and the prime document package follows the enclosure document package along the conveyor system, separated therefrom by a predetermined distance, and subsequently stacking the prime document package on top of the enclosure document package.

11. A method according to claim 10 further comprising reducing the speed of the document packages as they exit the conveyor system.

12. A method according to claim 10 comprising sensing the trailing edges of documents to calculate the predetermined distance.

* * * * *